US006288679B1

(12) United States Patent
Fischer et al.

(10) Patent No.: US 6,288,679 B1
(45) Date of Patent: Sep. 11, 2001

(54) SINGLE ELEMENT ANTENNA STRUCTURE WITH HIGH ISOLATION

(75) Inventors: Georg Fischer, Nurnberg (DE); Louis Thomas Manzione, Summit; Ming-Ju Tsai, Livingston, both of NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/583,614

(22) Filed: May 31, 2000

(51) Int. Cl.[7] ..... H01Q 21/24
(52) U.S. Cl. ..... 343/700 MS; 343/770
(58) Field of Search ..... 343/700 MS, 767, 343/769, 770, 829, 846; H01Q 21/24

(56) References Cited

U.S. PATENT DOCUMENTS 5,241,321 * 8/1993 Tsao ..... 343/700 MS
5,453,751 * 9/1995 Tsukamoto et al. ..... 343/700 MS
5,489,913 * 2/1996 Raguenet et al. ..... 343/767
5,534,877 * 7/1996 Sorbello et al. ..... 343/700 MS
6,008,763 * 12/1999 Nystrom et al. ..... 343/700 MS
6,054,953 * 4/2000 Lindmark ..... 343/700 MS

* cited by examiner

*Primary Examiner*—Tho G Phan
(74) *Attorney, Agent, or Firm*—J. Goo

(57) ABSTRACT

Disclosed is an antenna structure for transmitting and receiving electromagnetic signals, in particular for mobile telecommunication using the GSM Standard. The antenna structure allows for decoupling between the transmission path and reception path. The antenna structure has two preferably perpendicular couplings with two separate ports, for example for the connection of a transmitting device and a receiving device. Furthermore, the impedances of the two couplings can advantageously be matched, independently of one another, to the transmitting device and receiving device and/or the frequency bands of the signals to be transmitted or received.

32 Claims, 8 Drawing Sheets

SINGLE ELEMENT ANTENNA STRUCTURE WITH HIGH ISOLATION

FIELD OF THE INVENTION

The invention relates to an antenna structure for transmitting and receiving electromagnetic signals in general and, specifically, to transmission and reception within the Global System for Mobile Communications Standards (GSM).

BACKGROUND OF THE RELATED ART

In the course of a continuously increasing need for communication and mobility, transmission techniques using electromagnetic signals are of particular interest. The rapidly expanding field of mobile radio which operates, for example, using the Global System for Mobile Communications Standard (GSM), represents an important application of such transmission techniques. So-called base stations are used as connecting nodes in order to set up a connection between two mobile radio subscribers or one mobile radio subscriber and a communication subscriber in the fixed network. In order to ensure that simultaneous transmission and reception are guaranteed at all times on an existing connection the GSM Standard provides two separate frequency bands for transmitting and receiving the electromagnetic signals. For example, base stations using the GSM 900 Standard transmit in the 925 to 960 MHz frequency band, and receive in the 880 to 915 MHz frequency band. In order to transmit and receive the signals, a typical base station has a transmitting/receiving antenna in addition to transmitting and receiving amplifiers. This transmitting/receiving antenna in consequence has to cover the entire frequency range from 880 MHz to 960 MHz, that is to say has to have a minimum bandwidth of 80 MHz.

Dipole antennas or planar antenna structures, so-called patch antennas, are normally used for such applications. Both antenna types typically have one port for inputting the signals to be transmitted and for outputting the received signals. A so-called duplex filter or duplexer is used in order to use the antenna simultaneously for transmission and reception operation in adjacent transmitting and receiving frequency bands. The duplexer is essentially a frequency filter, in order to split the transmission and received signals between the transmission path and reception path on the basis of the frequency bands. For this purpose, the duplexer typically has three connections, one each for the antenna, the transmitter and the receiver. This results in separate ports at the duplexer for the connection of the transmitter and of the receiver (in this context, see also FIG. 8).

Since the signal levels of the transmitted and received signals are generally very different, the duplexer must have a very high attenuation for the transmitted frequencies at the receiver port, in order to avoid overdriving and blocking of the receiver, and thus a reduction in the receiver sensitivity. In addition, the received frequencies must also be heavily attenuated at the transmission port, since the so-called wideband noise from the transmitter may fall in the reception band. The losses in the duplexer resulting from the high level of mutual attenuation required in consequence lead in an extremely disadvantageous manner to a reduction in the effective transmission power, and to a reduction in the receiver sensitivity.

The joint use of a typical antenna structure with one port for transmission and reception operation also results in limitations regarding the line impedances used. The optimum impedances for coupling the antenna structure to the transmitter and to the receiver cannot be chosen independently of one another. Normally, the duplex filters do not carry out any impedance transformation, so that the antenna structure, transmitter and receiver have the same impedance. A real impedance of 50 ohms is frequently selected for all the ports, as a compromise.

A semiconductor is normally used as the power output stage in the transmission path, typically having a low output impedance, and the impedance is thus transformed up to 50 ohm by means of a matching network. Owing to the transmitter and receiver having the same impedance, direct noise matching between the antenna structure and the first amplifier stage is not possible in the reception path either. A matching network is typically likewise used in order to transform the impedance of the coupling to the antenna structure to the optimum source impedance to achieve a minimum noise factor. However, losses in the matching networks result in a further disadvantageous reduction in the reception sensitivity and the transmission power. In general, matching networks also have the disadvantage that, as additional components, they result in costs and a space requirement.

Further disadvantages result in particular for the use of planar patch antennas, since planar antenna structures have relatively narrow bandwidths, so that it is impossible to use them for applications with wide bandwidth requirements. In this case, it is disadvantageous that the bandwidth of a normal antenna structure with one port has to cover the entire frequency range from the lowest to the highest operating frequency, which entire range comprises at least the width of the sum of the bandwidths of the transmission and reception bands, that is typically even wider, however, since there is also a guard band between the transmission band and the reception band.

Although antennas having two ports are already known, these structures are dimensioned such that the same frequency range is output at both ports. In these antennas, two mutually orthogonal polarizations are output from the same resonator. When so-called "dual polarized" structures are used in transmitting/receiving systems, a duplex filter is then connected downstream of each of the two ports, which once again leads to the series of disadvantages described above.

SUMMARY OF THE INVENTION

One object of the invention is thus to provide an antenna structure for transmitting and receiving electromagnetic signals, which avoids at least some of the disadvantages of the prior art.

A further object of the invention is to provide an antenna structure which ensures decoupling between the transmission path and reception path and, in particular, separate ports for the connection of the transmitter and the receiver.

The object is achieved in a surprisingly simple manner just by the features of Claim 1. Preferred developments are the subject matter of the dependent claims.

The antenna structure according to the invention comprises a first and a second conductive element, which are at a distance from one another and essentially form a resonator for electromagnetic oscillations. The antenna structure furthermore comprises a first and a second coupling. The first coupling comprises a port via which signals in a transmission band are preferably input into the resonator, and the second coupling comprises a port, via which signals in a reception band are preferably output. In this case, the impedance of the first coupling for frequencies from the transmission band is matched to a transmitting device, and the impedance of the second coupling for frequencies from the reception band is matched to a receiving device. The antenna structure according to the invention thus simultaneously allows signals to be transmitted in the transmission band and to be received in the reception band, and to be assigned to the transmitting device and the receiving device via the two separate ports. Thus, advantageously, there is no need for any additional frequency filter, in the form of a duplex filter, between the antenna structure and the transmitting and receiving devices.

The frequency selectivity which is provided by the duplex filter for conventional transmitting/receiving antennas, in order to split the frequency range on the basis of the transmission band and reception band, is thus achieved just by the antenna structure, according to the invention, itself. Losses are thus avoided, which leads to an improvement in the reception sensitivity and the effective transmitted power.

Furthermore, the two couplings and the two resonant axes of the antenna structure can be optimized independently of one another, which allows line impedances which can be chosen independently of one another for the transmitter and receiver. No transformation networks are therefore required for impedance matching, thus advantageously avoiding their losses as well.

In the reception path, this means an improvement in the sensitivity of the receiver with respect to the radio interface. The second coupling to the receiver is advantageously matched to a minimized noise factor, and the matching is carried out, for example, with respect to the first amplifier stage. This optimum impedance value is generally specified as "$\gamma_{opt}$" in the data sheet for the receiver transistor and, typically, is about $\gamma_{opt}$=50 to 100 ohm. The preferable saving of the transformation networks means, with respect to the receiver, a saving in space and components, which is particularly advantageous for preferable integration of the antenna structure with the receiver or parts of the receiver.

The advantages for the transmitter are similar to those for the receiver. The impedance of the first coupling is preferably matched to the optimum terminating impedance of the transmitting device, for example to the last amplifier stage, in order to achieve optimum power transfer, which is referred to as power matching. The terminating impedance of a typically used line transistor is about 5 ohm, and the impedance of the coupling for power matching is essentially chosen to be equal to the terminating impedance of the power transistor. There is thus no need for an impedance matching network. Avoiding additional losses in the matching network leads to greater transmitter power efficiency with respect to the radio interface. The avoidance of the matching network in the transmission path likewise leads to a saving in space and components which, in this case as well, is particularly advantageous for integration of the antenna structure with the transmitter or parts of the transmitter.

The dimensions of the resonator are preferably matched in one dimension to the frequencies from the first frequency band, and in a second dimension to the frequencies from the second frequency band, so that each of the two resonant axes of the resonator need have only roughly the bandwidth of the transmission band or reception band. This, for example, at least halving of the required bandwidth of the antenna structure is a major advantage, since it is now also possible to use cheaper, planar antenna structures for systems in which it has not been possible to use such structures in the past, owing to the wide bandwidth requirement. An exemplary embodiment illustrated in FIG. 12 shows these relationships relating to frequency splitting. In this case, it is advantageous that the transmission band and reception band do not overlap and are preferably separated from one another by approximately the width of the transmission band and/or reception band, that is to say they are separated from one another by a guard band, in order to achieve particularly effective separation between the transmitted signals and received signals.

One preferred embodiment of the antenna structure comprises a third conductive element, which is essentially used as a screening earth.

One preferred design of the antenna structure embodies the conductive elements and couplings in the following sequence. The first conductive element is located right at the front in the emission direction, in each case followed at a defined distance by the first coupling, then the second conductive element, then the second coupling and, finally, the third conductive element. Furthermore, the conductive elements and the couplings are preferably designed to be flat and parallel to one another. This design results in the antenna structure forming a compact unit, and the two couplings are advantageously screened from one another by the second conductive element, thus achieving a high level of decoupling. The screening earth reduces the emission in the backward direction, that is to say the so-called front-to-back ratio is improved.

In one embodiment, the conductive elements are essentially in the form of sheet metal. These elements can, for example, be produced particularly easily and cheaply.

In a particularly preferred development, the conductive elements comprise a plurality of openings, for example in the form of a perforated sheet. Alternatively, the conductive elements also comprise a conductive, for example metallic, grating. It has been found that the structure in the form of a perforated sheet or the grating results in particularly effective decoupling of the signals which are input into the resonator via the first and second couplings. This is particularly true if the perforation or grating structures run parallel to the couplings which are, in particular, at right angles to one another.

The preferably flat first conductive element is preferably smaller than the second conductive element, in which case the former is then called a patch. This improves the emission and the reception of the electromagnetic signals around the patch. Alternatively, the first conductive element comprises an opening, which likewise improves transmission and reception. The patch and/or the said opening are, for example, shaped to be rectangular, ellipsoid, polygonal, for example pentagonal, or as an elliptical ring. The length of width of the patch or the said opening mean that it is possible to choose the resonant frequencies of the resonator to be virtually independent of one another for the two directions along the edges of the rectangle, or the major axes of the ellipsoid, although the magnitude thus influences the impedances of the two axes of the antenna structure.

The second conductive element preferably comprises an opening which is, in particular, in the form of a cruciform slot. The cruciform slot is defined by two rectangular slots which are preferably at right angles to one another, and the slots run, in particular, parallel to the two couplings. The perpendicular arrangement makes the decoupling particularly effective, since the two polarization directions of the signals to be transmitted and of the received signals are likewise essentially at right angles to one another. The crossing area is preferably chosen to be as small as possible in order to optimize the decoupling between the first and second couplings.

The two couplings project, in particular, beyond the cruciform slot on the side located opposite the port, wherein it is possible to use the length of the overhang, once again, to set the impedance for the two couplings separately.

The antenna structure preferably contains one or more dielectrics between in each case two of the components, that is to say couplings and conductive elements. The choice of the dielectric constants allows, for example, the impedance and thus, in particular, the resonant frequency of the resonator to be matched. By choosing different dielectrics, the impedance for the first and second couplings can be influenced separately, and the impedance can also be varied by the distances between the components.

At least regions of the antenna structure can advantageously be designed using microstrip or stripline technology, since these can be produced cheaply, and the conductive elements and couplings and the dielectrics can be attached, preferably bonded, to one another alternately. When these techniques are used, the conductive elements and couplings are formed, for example, by etching or vapour-deposition.

The invention, its further advantageous refinements and the prior art will be explained in more detail using the following specific exemplary embodiments and with reference to the figures.

DETAILED DESCRIPTION

Figure 1:
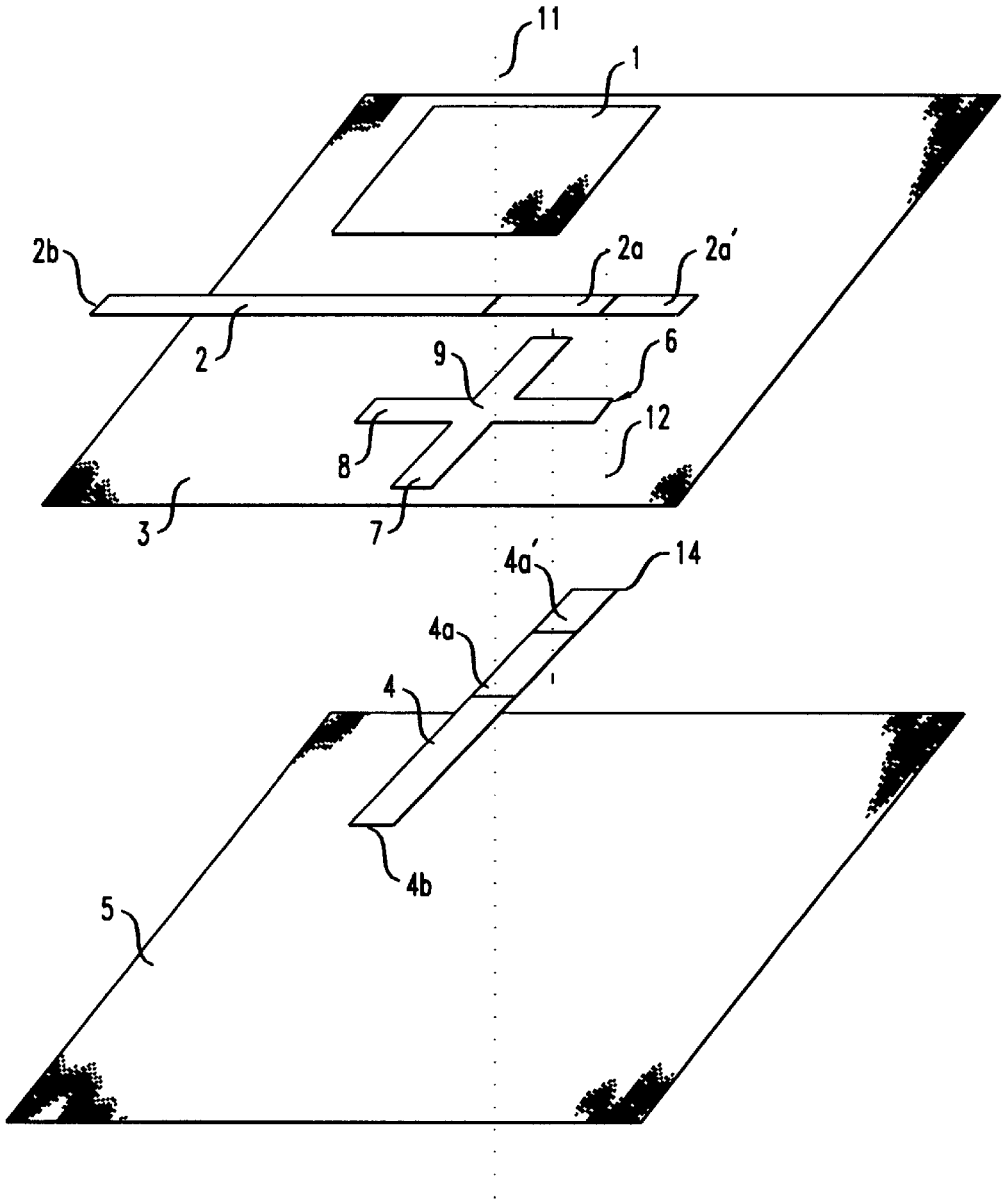
FIG. 1 shows a perspective, exploded view of the antenna structure according to the invention.
Figure 18:
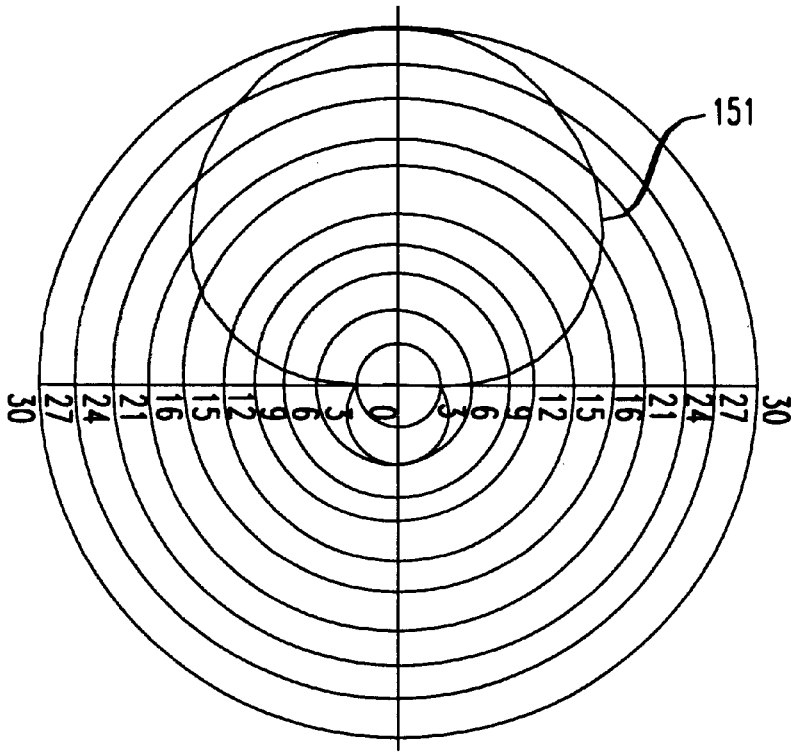
FIG. 18 shows a diagram of the directional characteristic of the antenna structure from FIG. 10, when fed at the transmission port in the section plane 150 from FIG. 17.

FIG. 1 shows a first earth surface or a patch 1, arranged above a first coupling 2, in turn arranged above an earth surface 3, in turn arranged above a second coupling 4, in turn arranged above an earth surface 5. The patch 1, the first and second couplings 2, 4 and the earth surfaces 3, 5 are metallically conductive and have a flat rectangular shape, with the first and second couplings 2, 4 being formed to be elongated. The earth surface 3 contains a cruciform opening 6 which comprises a first and a second elongated-rectangular slot 7 and 8, which define the crossing region 9. In order to illustrate the perspective better, three mutually parallel axes 11, 12, 14 are shown. The patch 1, the first and second couplings 2, 4 and the earth surfaces 3, 5 are arranged parallel to one another and in each case at right angles to the axes 11, 12 and 14. The axis 11 intersects the patch 1, the crossing region 9 and the earth surfaces 3 and 5 at each of their centres. The axis 11 likewise intersects the first and second couplings 2, 4. The first coupling 2 runs parallel to the second slot 8, and the second coupling 4 runs parallel to the first slot 7. The first and second couplings 2, 4 each have a region 2*a* or 4*a*, respectively, extending between the axis 11 and the corresponding axis 12 or 14, respectively. The couplings 2, 4 furthermore have a section 2*a*′, 4*a*′ which projects beyond the respective parallel slot 8 or 7, respectively, which is indicated by the two axes 12, 14, which axes 12, 14 respectively show the end of the second and first slots 8 and 7, respectively. The patch 1 and the earth surface 3 together form a cavity resonator. The earth surface 5 forms a screening earth in order to improve the front-to-back ratio. The first and second couplings 2, 4 respectively have a terminating end or port 2*b* or 4*b* respectively, to which the transmitter or the receiver (not shown in FIG. 1), respectively, is connected. The transmission power input from the transmitter and emitted from the resonator is essentially emitted directed upwards along the axis 11. FIG. 18 shows the directional characteristic of the emission.

The impedance of the couplings 2, 4 of the antenna structure can be matched to the transmitter and receiver, respectively, by the length of the associated slot and by the overhanging line length which projects beyond the associated slot. The first and second slots 7 and 8, respectively, are associated with the first and second couplings 2 and 4, respectively, that is to say that which is arranged at right angles to the coupling line 2 or 4, respectively. These two design parameters, which can in each case be varied independently, allow both the real and the imaginary part of the impedances to be matched separately in both directions, so that it is possible to choose virtually any point on the Smith diagram. In order to achieve as high a level of decoupling between the transmitter port and receiver port as possible, the width of the slots 7, 8 is chosen to be as small as possible, since the overlapping area 9 of the two slots arranged in a cruciform shape is a measure of the coupling. Narrow slots are also advantageous owing to the undesirable emission from the slots into free space. The length of the first and second slots 7 and 8, respectively, is matched, inter aila, to the impedance of the transmitter or receiver, respectively, the impedance of the couplings and the corresponding frequency band. The cruciform shape is thus not necessarily symmetrical. This is particularly necessary if the impedances for coupling the transmitter and receiver are different. However, minor differences in the length also occur for the same impedances just from the slightly different emission behaviour of the antenna structure on its two resonant axes, which are associated with different frequency bands. In this context, it is also not disadvantageous for the polarizations of the transmitted and received signals to be different, since different propagation conditions result just from the use of different frequencies for transmission and reception, and the polarization of a propagating radio wave is in any case heavily influenced by the mobile radio channel (polarization conversion).

Figure 14:
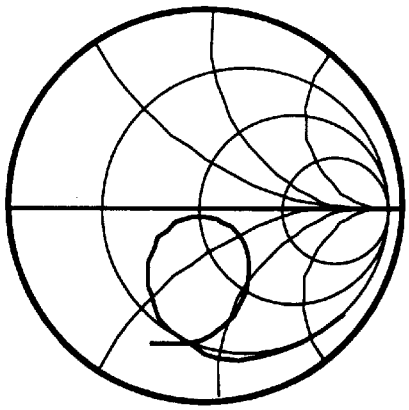
FIG. 14 shows a diagram of the locus curve of the input impedance at the transmitter port for the antenna structure from FIG. 10.
Figure 15:
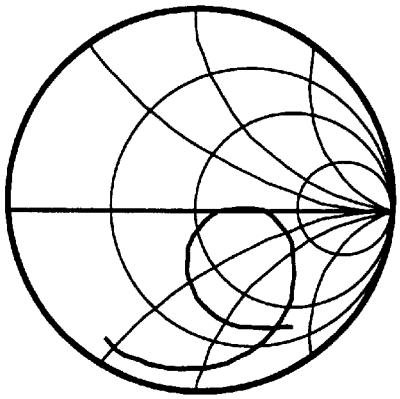
FIG. 15 shows a diagram of the locus curve of the input impedance at the receiver port for the antenna structure from FIG. 10.

The impedance curve is represented using a Smith diagram, the size of the resonance circle is influenced by the choice of the length of the slots 7 and 8 (see FIGS. 14, 15). Stretching a slot in this case corresponds to enlarging the resonance circle. In order to set the reactive part of the desired impedance, the length of the overhanging line which projects beyond the slots 7 or 8, respectively, associated with the couplings 2 and 4, that is to say is at right angles to the line, is matched. The first and second couplings 2 and 4, respectively, should thus overhang by half the length of the second and first slots 8 and 7, respectively, that are not associated with the coupling, in order to completely cover the cruciform slot 6. The overhanging length is thus at least half as long as the length of the slot not associated with it. However, this does not represent any significant limitation since virtually any desired reactive element can be set by means of the additionally overhanging sections 2*a'* and 4*a'* beyond half the length of the slot which is not associated.

Figure 2:
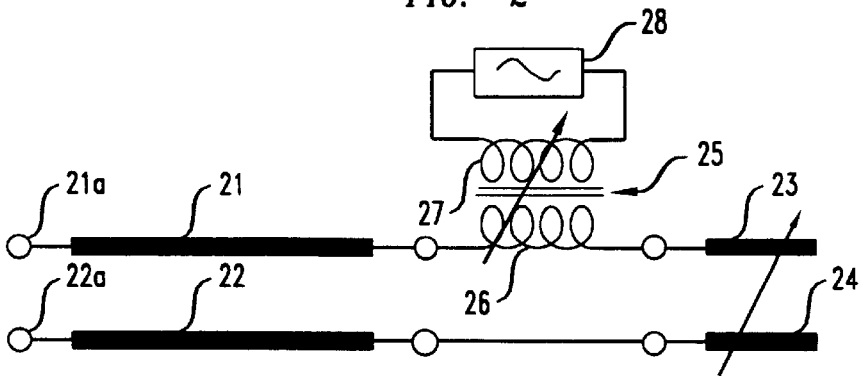
FIG. 2 shows an equivalent circuit for one of the two ports of the antenna structure from FIG. 1, FIGS. 3 to 7 show sections through further embodiments of the antenna structure according to the invention.

FIG. 2 shows an equivalent circuit of the transmission path of the antenna structure from FIG. 1. A line having two conductors 21 and 22 is connected by in each case one connection 21*a* or 22*a*, respectively, to an aperture-coupled emitter. The upper conductor 21 is connected to the primary winding 26 of a transformer 25, and the secondary winding 27 of the transformer 25 feeds the radiation impedance 28. The primary winding 26 is connected to the upper conductor section 23, and the lower conductor 22 is connected to the lower conductor section 24. The two conductor sections 23 and 24 form an open-circuit line with an impedance Z, that is to say essentially a capacitor. The aperture coupling is modelled in the equivalent circuit by the transformer 25, whose transformation ratio is influenced by the slot length. The overhanging line is covered by the open-circuit line 23 and 24, which essentially represents a reactive component and is connected is series with the primary winding 26 of the transformer 25. The resonator and its emission are modelled by the radiation impedance 28, which is connected to the secondary winding 27 of the transformer 25. The degrees of freedom resulting from the slot length and the length of the overhanging line allow the input impedance at the two ports to be set within wide limits.

Figure 3:
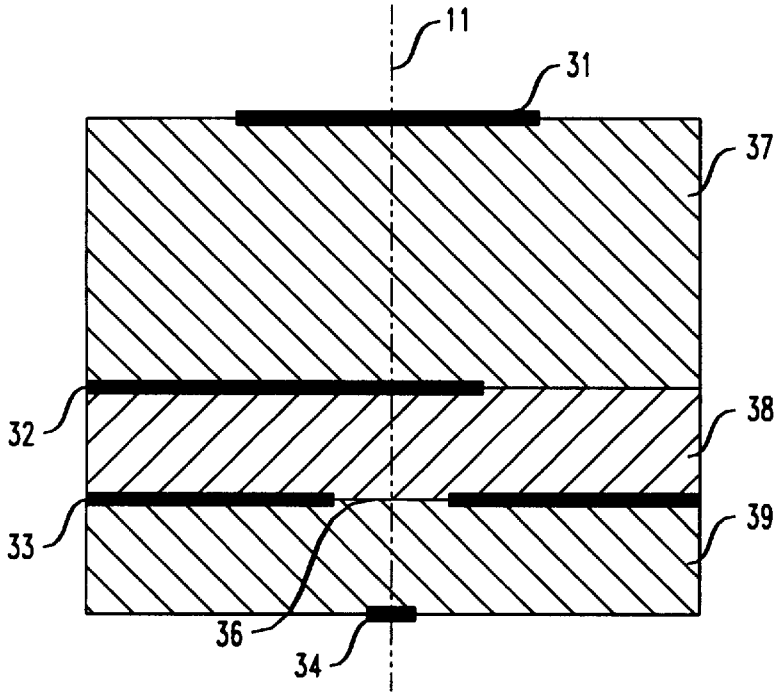
Figure 4:
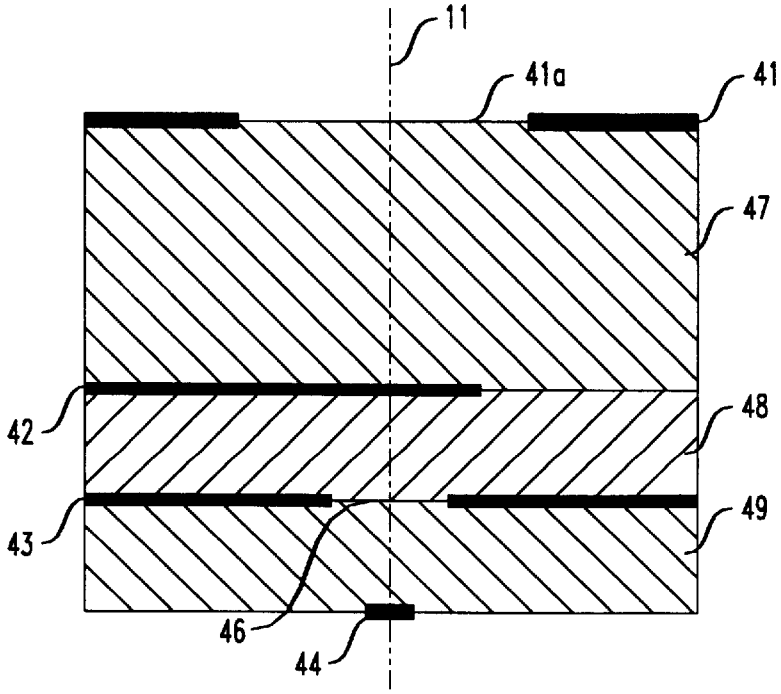

FIG. 3 shows a patch 31, a first coupling 32, an earth surface 33 with a cruciform slot 36, a second coupling 34, a resonator dielectric 37, a first dielectric 38, a second dielectric 39 and the axis 11. The resonator dielectric 37 is located between the patch 31 and the first coupling 32. The first dielectric 38 is located between the first coupling 32 and the earth 33. The second dielectric 39 is located between the earth surface 33 and the second coupling 34. FIG. 4 shows an earth surface 41 with an opening 41*a*, a first coupling 42, an earth surface 43 with a cruciform slot 46, a second coupling 44, a resonator dielectric 47, a first dielectric 48, a second dielectric 49 and the axis 11. The resonator dielectric 47 is located between the earth surface 41 and the first coupling 42. The first dielectric 48 is located between the first coupling 42 and the earth surface 43. The second dielectric 49 is located between the earth surface 43 and the second coupling 44. The multi layer construction of the antenna structure allows different dielectrics 37, 38 and 39 or 47, 48 and 49, respectively, to be used for the coupling lines 32 and 34, or 42 and 44, respectively, and the resonator in the two embodiments. For example, a dielectric having a high dielectric constant is advantageous for microstrip lines, since this reduces the undesirable emission. On the other hand, a dielectric with a low dielectric constant, for example even air, is advantageous for the resonator, since this leads to a wide bandwidth as well as the resonator being short in height.

Figure 5:
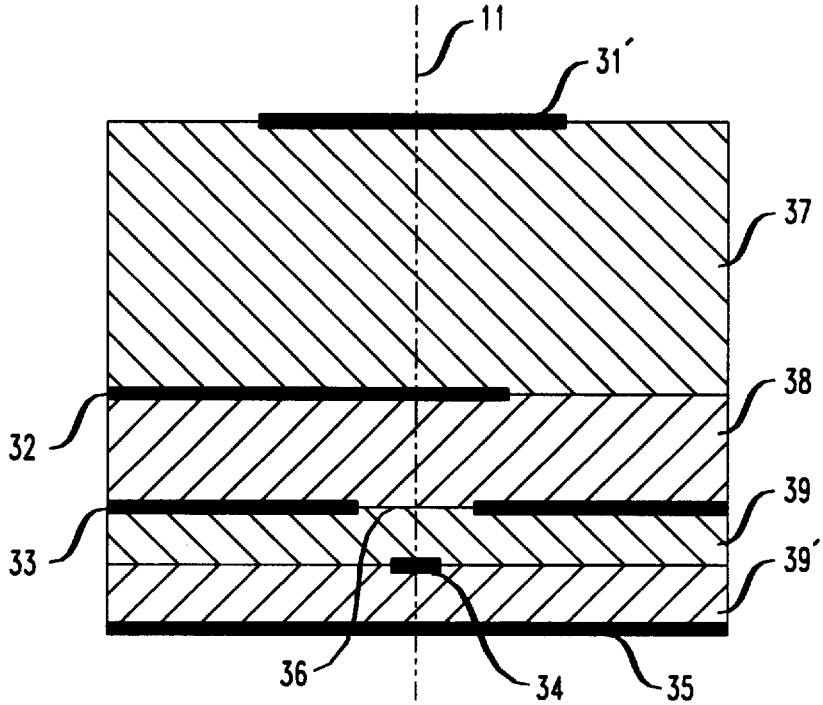
Figure 6:
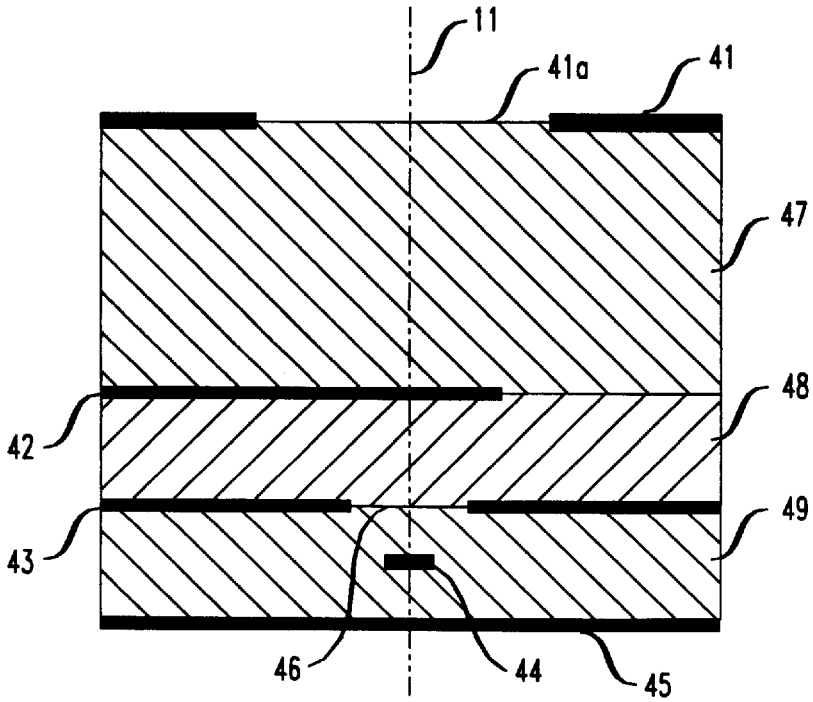

A further embodiment of the invention is for the underneath of the antenna structure to be provided with a screening earth, by which means undesirable emission from the underneath is advantageously suppressed, or at least attenuated. The ratio of the radiated power in the forward direction to the radiated power in the backward direction for an antenna is called the front-to-back ratio which, in consequence, is improved by the additional screening earth. FIG. 5 shows a similar construction to that in FIG. 3 with an additional earth surface 35, which is arranged underneath the second coupling 34. A third dielectric 39', which preferably has a dielectric constant different from that of the second dielectric 39, extends from the second coupling 34 to the earth surface 35. In this embodiment, the patch 31' is in the form of a metallic grating. In an alternative embodiment, the patch 31' is in the form of a structure like a perforated sheet. FIG. 6 shows a similar construction to that in FIG. 4, with an additional earth surface 45 likewise being arranged underneath the second coupling 44 and the second dielectric 49 extending from the earth surface 43 to the earth surface 45.

Figure 7:
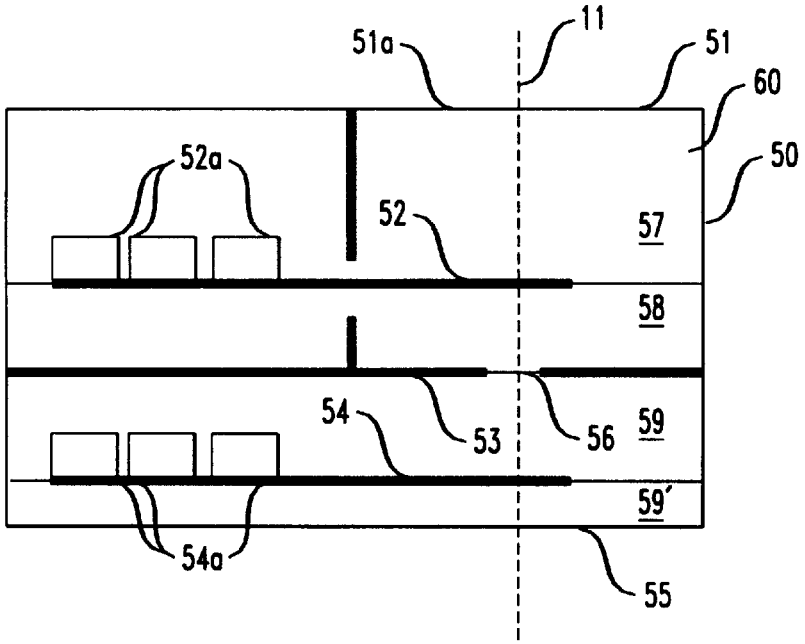

A further advantageous embodiment of the invention, in which parts of the transmitter and parts of the receiver are integrated in the resonator and the antenna structure, is shown in FIG. 7. This results in an active antenna structure 50 which is active not only in the transmission path but also in the reception path. In this case, it is advantageous for a first coupling 52 to be located above an earth 53, and for a second coupling 54 to be located underneath the earth 53. Circuit elements 52*a* in the transmitter are in consequence screened from circuit elements 54*a* in the receiver. The circuit elements 52*a* in the transmitter are advantageously arranged above the earth 53, and the first coupling 52 is used for transmission. The signals to be transmitted are essentially emitted through an opening 51*a* in an earth surface 51. The circuit elements 54*a* in the receiver are advantageously arranged underneath the earth 53, and the receiver uses the second coupling 54. Positioning the transmitter circuit elements 52*a* on the top of the earth 53, where the resonator and the emitting part of the antenna structure are also located, reduces problems with emitted signals being injected into the receiver which, in this preferred embodiment, is located on the underneath of the earth 53. It is also advantageous that the coupling of the receiver through the cruciform slot 56 in the earth surface 53 allows virtually complete encapsulation of the receiver circuit elements 54*a* from the transmitter as well as from the resonator. An earth surface 55 is essentially used, in a similar way to the design in FIGS. 5 and 6, to improve the front-to-back ratio. Four dielectrics 57, 58, 59 and 59' which are matched independently of one another, are located between the earth surface 51 and the coupling 52, the coupling 52 and the earth surface 53, or the earth surface 53 and the earth surface 55.

Figure 8:
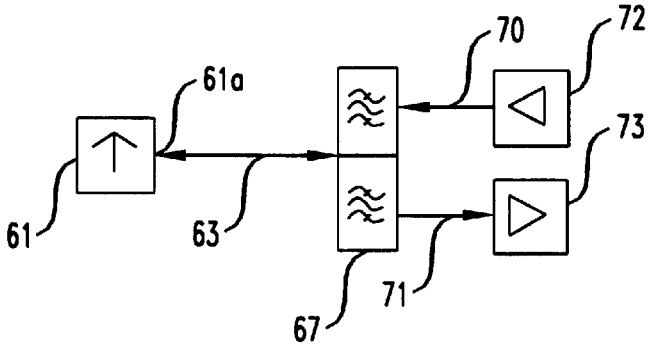
FIG. 8 shows a block diagram of a design having an antenna structure according to the prior art.

FIG. 8 shows a design having an antenna structure 61 with a port 61*a*, according to the prior art. A line 63 connects the antenna structure 61 to a duplex filter 67. A transmitter 72 is connected to the duplex filter 67 by a line 70, and a receiver 73 is connected to the duplex filter 67 by a line 71. The duplex filter 67 forms a frequency filter which supplies signals received from the antenna structure 61 within a reception band, via the line 71, to the receiver 73. The signals transmitted in the transmission band from the transmitter 72 are passed via the line 70, via the duplex filter 67 and via the line 63 to the antenna structure 61. The duplex filter 67 is required for the antenna structure 61 in order to decouple the transmitter and the receiver, which leads to the disadvantages described in the introduction.

Figure 9:
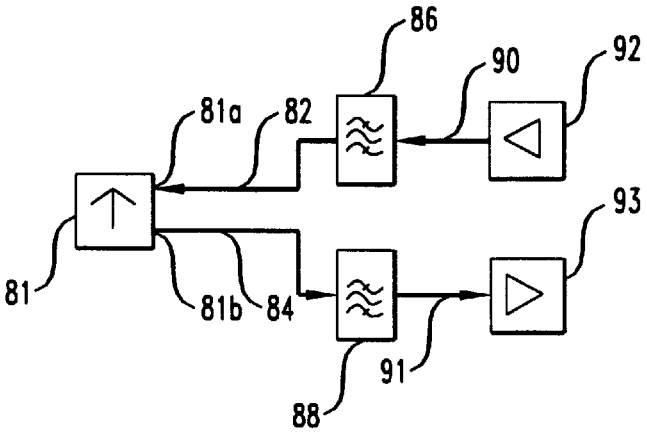
FIG. 9 shows a block diagram of a design having the antenna structure according to the invention.

Although, in many embodiments of the present invention, the selectivity of the antenna structure is sufficient on its own, so that no downstream transmission or reception filters are required, it is advantageous to provide filters in the separate transmission and reception paths, to provide further transmitter and receiver decouplings. FIG. 9 shows one such preferred embodiment of the invention having an antenna structure 81 which has a first and a second port 81*a* and 81*b*, respectively, as well as a transmission filter and a reception filter 86 and 88, respectively. A transmitter 92 is connected via a link 90 to the transmission filter 86, which is connected via a link 82 to the first port 81*a* of the antenna structure 81. A receiver 93 is connected by a link 91 to the reception filter 88, which is connected by a link 84 to the second port 81*b* of the antenna structure 81. Signals which are received by the antenna structure 81 are passed via the port 81*b*, the link 84, the reception filter 88 and the link 91 to the receiving device 93. Signals transmitted by the transmitter 92 are passed via the link 90, the transmission filter 86, the link 82 and the first port 81*a* to the antenna structure 81, in order to be emitted from it. The two filters 86 and 88 are used to provide additional advantageous decoupling between the transmission and the reception paths. Since the antenna structure according to the invention and having a transmitter port and a receiver port on its own provides a high level of decoupling between the transmission signal and the received signal, the need for the downstream transmission and reception filters 86, 88 is considerably less than the need for the duplex filter in an antenna structure having only one common port for the transmitter and the receiver.

Figure 10:
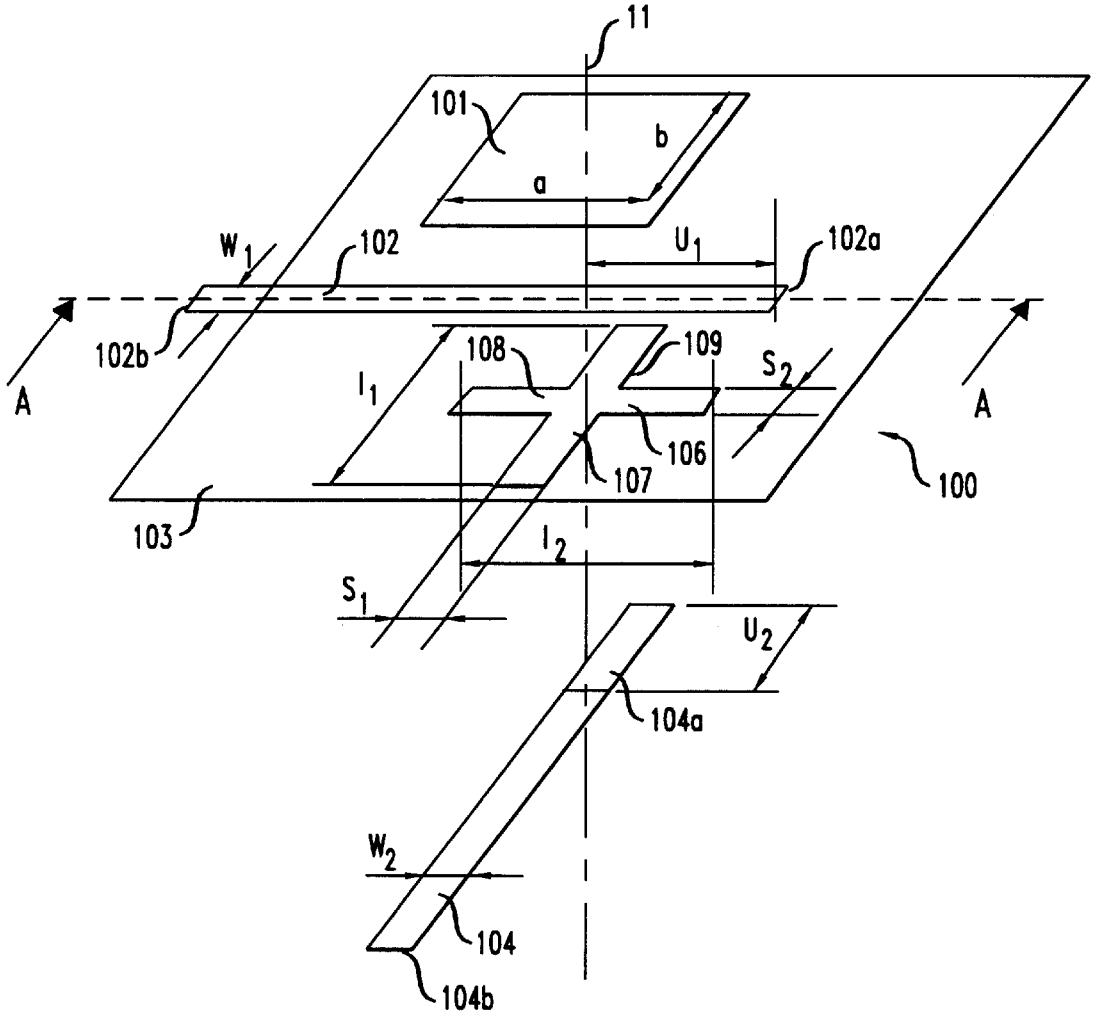
FIG. 10 shows a perspective, exploded view of the antenna structure according to the invention for the GSM 900 Standard.

FIG. 10 shows the axis 11, a patch 101, a coupling 102 with an overhanging section 102*a* and a transmission port 102*b*, an earth surface 103 and a second coupling 104 with an overhanging section 104*a* and a receiver port 104*b*. The earth surface 103 surrounds an opening 106 which is defined by the two slots 107 and 108, and which two slots 107, 108 define a cruciform region 109. The patch 101 has a rectangular shape and is defined by the dimensions a=137 mm and b=144 mm. The slots 107 and 108 which define the cruciform opening 106 in the earth surface 103 have the lengths $l_1$=66 mm and $l_2$=66 mm, respectively, and the widths $s_1$=0.2 mm and $s_2$=0.2 mm, respectively. The first coupling 102 has a width $w_1$=1.135 mm, and its overhanging region 102*a* beyond the associated slot 107 has a length $u_1$=40 mm. The second coupling 104 has a width $w_2$=1.135 mm, and its overhanging region 104*a* beyond the associated slot 108 has a length $u_2$=40 mm.

Figure 11:
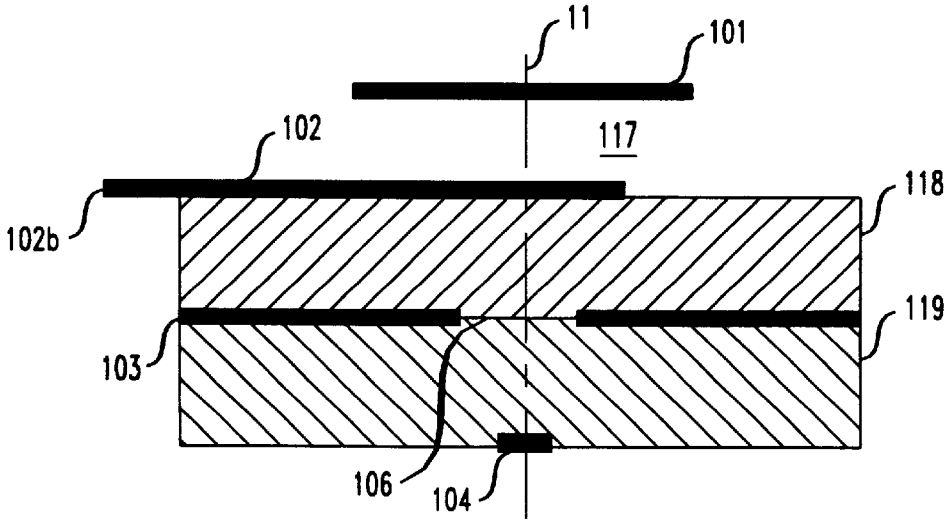
FIG. 11 shows a section through the antenna structure from FIG. 10 along the axis A—A.

FIG. 11 shows a section of the antenna structure from FIG. 10 along the axis A—A. The sequence of the elements from top to bottom is as follows: patch 101, resonator dielectric 117, transmitter coupling 102, first dielectric 118, earth surface 103, second dielectric 119 and receiver coupling 104. The distance between the patch 101 and the transmitter coupling 102 is 8 mm, and is defined by spacer sleeves (not shown). The distance between the transmitter coupling 122 and the earth surface 123 as well as between the earth surface 123 and the receiver coupling 124 is in each case 0.5 mm, and is defined essentially by the thickness of the two dielectrics 118 and 119, which is in direct contact with the transmitter coupling 102 and the earth surface 103 and, respectively, the earth surface 103 and the receiver coupling 104. In one preferred embodiment, these are bonded to one another or are permanently connected in some other way. Air is used as the resonator dielectric 117. The material R04003 is used as the first and second dielectrics 118 and 119. The material R04003 has a dielectric constant of $\epsilon$=3.38.

The use of the same substrate R04003 for transmitter and receiver couplings leads to a simple, symmetrical design with respect to the earth 103, which is advantageous for production. The width $w_1$=$w_2$=1.135 mm of the two couplings 102 and 104 corresponds to a characteristic impedance of 50 ohms for the coupling lines 102, 104. With the described dimensions, the antenna structure is suitable for use in a GSM base station system using the frequency splitting for the GSM900 Standard according to FIG. 12. The dimensions are optimized to achieve a higher level of isolation between the transmitter and the receiver ports. Reducing the widths $S_1$ and $S_2$ of the slot 107 and 108, respectively, would be advantageous in terms of improving the isolation, but is generally impossible for practical reasons.

Figure 12:
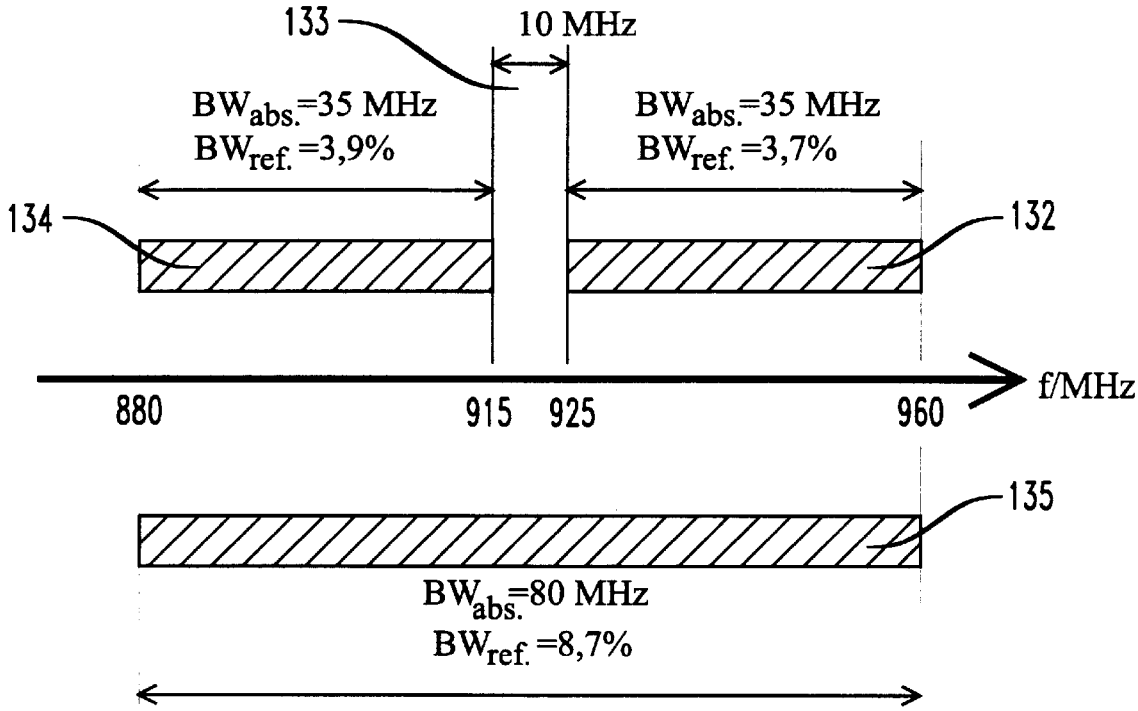
FIG. 12 shows the frequency splitting into the transmission and reception bands of an E-GSM900 mobile-radio base station

FIG. 12 shows frequency splitting into a transmission band 132 and a reception band 134 for an E-GSM mobile radio base station at 900 MHz. The x-axis shows the frequency in Megahertz. The reception band 134 extends from 880 MHz to 915 MHz. The transmission band 132 extends from 925 MHz to 960 MHz. The two bands thus have an absolute bandwidth of $BW_{abs.}$=35 MHz. This means a relative bandwidth of $BW_{rel.}$=3.9% for the reception band and $BW_{rel.}$=3.7% for the transmission band. There is a 10 MHz-wide guard band 133 between the transmission band 132 and the reception band 134. The full bandwidth 135 $Bw_{abs.}$=80 MHz, which results from the sum of the bandwidths of the transmission, reception and guard band 132, 134 and 133, respectively, is shown underneath the x-axis. An antenna structure having one port, as is shown in FIG. 8, has to have the entire bandwidth $BW_{abs.}$=80 MHz in order to be able to transmit and receive. The antenna structure according to the invention and as shown in FIG. 10 having two ports, need in each case have only the bandwidth 134 or 132, respectively, of $BW_{abs.}$=35 MHz for the reception path and the transmission path. The bandwidth requirement for the antenna according to the invention is, in consequence, advantageously less than half as great as for the antenna according to the prior art.

Figure 13:
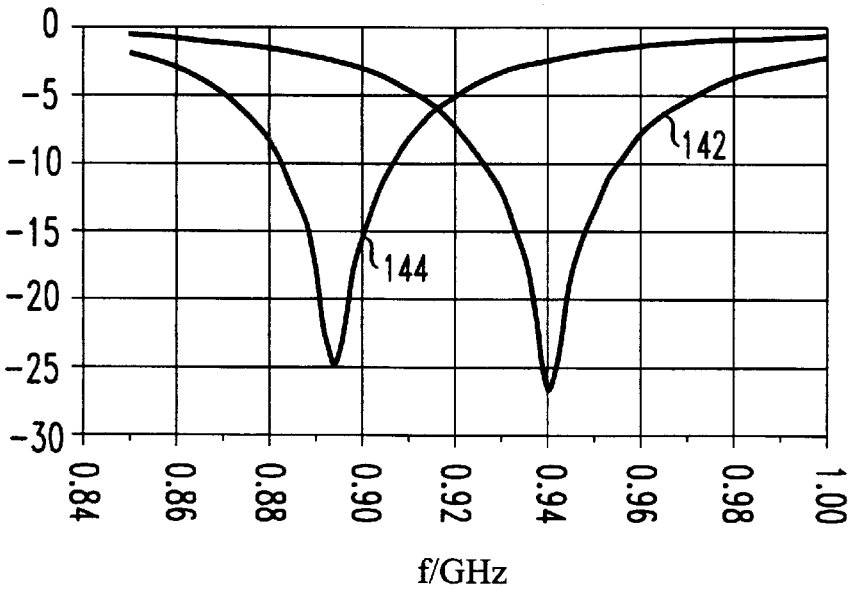
FIG. 13 shows a diagram of the reflection loss at the transmitter and receiver ports for the antenna structure from FIG. 10.

FIG. 13 shows the input matching curves 142 and 144 of the transmitter port and receiver port, respectively, of the antenna structure from FIG. 10. The x-axis shows the frequency in Gigahertz from 0.84 GHz to 1.00 GHz, and the y-axis shows the reflection loss s11 and s22 in dB.

FIGS. 14 and 15 show the locus curves of the input impedance at the transmitter port (FIG. 14) and at the receiver port (FIG. 15), respectively, for the antenna structure from FIG. 10. The locus curves are in each case shown as a Smith diagram, normalized to 50 ohms. The locus curves are both shown for a frequency from 850 MHz to 1 Gigahertz.

Figure 16:
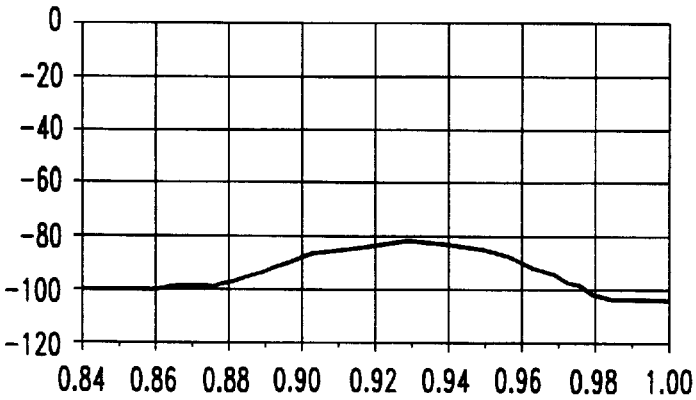
FIG. 16 shows a diagram of the decoupling between the transmitter and receiver ports for the antenna structure from FIG. 10.

FIG. 16 shows the isolation or decoupling between the transmitter port and the receiver port for the antenna structure from FIG. 10. The x-axis shows the frequency in Gigahertz from 0.84 GHz to 1.0 GHz, and the y-axis shows the isolation S21 in dB. In the illustrated frequency range, the isolation achieves theoretically calculated values of between about −105 dB and about −80 dB. In practice, about 40 dB is achieved due to production tolerances. The decoupling achieved just by the antenna structure is thus of a similar order of magnitude to that of a typical duplex filter, such as those used for antennas according to the prior art.

Figure 17:
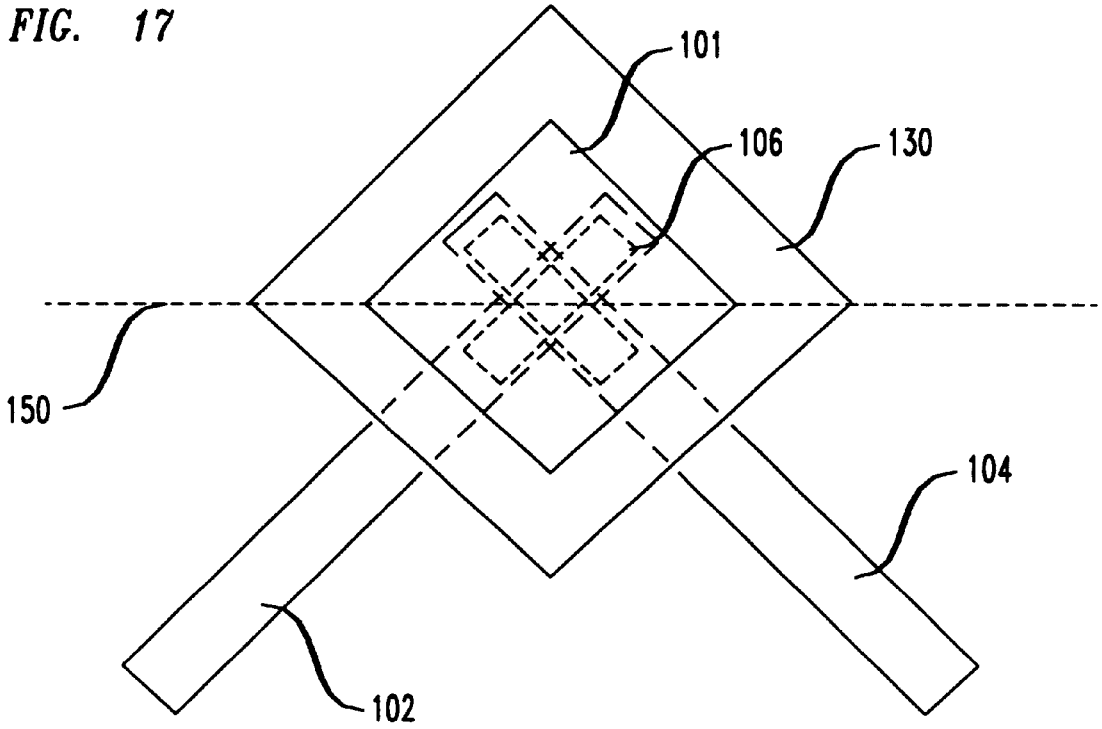
FIG. 17 shows a plan view of the antenna structure from FIG. 10.

FIG. 17 shows the patch 101, the transmitter coupling 102, the earth surface 103 with the opening 106, and the receiver coupling 104, which are located one above the other in the stated sequence, and a section plane 150. The earth surface 103 has a rectangular shape, and the section plane 150, which is preferably located parallel to the horizontal, runs diagonally through the earth surface 103 and extends at right angles to the plane of the illustration.

Since the mobile radio channel has a strong influence on the polarization of transmitted waves, an arrangement of the two resonant axes as shown in FIG. 17 was chosen, and the directional characteristic was thus investigated in the 45° section along the plane 150. This is shown as a polar diagram in FIG. 18. The y-axis in this case points along the axis from FIG. 10. The distance from the origin of the graph corresponds to the intensity of the transmitted signals. The beam angle of the emission lobe 151 is about 60°. The antenna structure is thus particularly and advantageously suitable for sectorized transmission/reception cells in mobile radio base stations.

On the basis of the numerous embodiments and variation options described, the fundamental nature of the invention will be evident to a person skilled in the art, and it is thus obvious that the invention is not limited to the specific examples but may be varied in a particularly large number of details without departing from the context of the invention.

What is claimed is:

1. An antenna structure with a first port for transmission of electromagnetic signals and a second port for reception of electromagnetic signals, said antenna structure comprising:

a first and second electrically conductive element essentially forming a resonator defining at least a first and second resonant axis;

a first coupling assigned to said first port and arranged to excite said resonator in a direction parallel to said first resonant axis with frequencies of a first frequency band;

a second coupling assigned to said second port and arranged to excite said resonator in a direction parallel to said second resonant axis with frequencies of a second frequency band, wherein said first resonant axis is adapted to transmit signals with frequencies of said first frequency band, and said second resonant axis is adapted to receive signals with frequencies of said second frequency band, and wherein said first and second frequency bands are different from one another, and wherein said antenna structure provides electromagnetic isolation between said first and second port.

2. The antenna structure of claim 1, wherein the impedance of the first coupling is matched to the transmitting device for maximum power transfer and a noise matching of the impedance of the second coupling to the receiving device is provided.

3. The antenna structure of claim 1 or 2, wherein the dimensions of the resonator in one dimension are essentially matched to the frequencies from the first frequency band and, in a second dimension, are essentially matched to the frequencies from the second frequency band.

4. The antenna structure of claim 1 or 2, wherein the first and the second frequency bands do not overlap.

5. The antenna structure of claim 4, wherein the first and second frequency bands have a band separation from one another in the order of magnitude of the bandwidth of at least one of the first and second frequency bands.

6. The antenna structure of claim 1, wherein the first coupling is arranged between the first and second electrically conductive elements, and the second electrically conductive element is arranged between the first and second couplings.

7. The antenna structure of claim 1, which comprises a third electrically conductive element, wherein the second coupling is arranged in particular between the second and third electrically conductive elements.

8. The antenna structure of claim 7, wherein couplings and the conductive elements are formed flat and are arranged parallel to one another.

9. The antenna structure of claim 7, wherein at least one of the first, second and third electrically conductive elements comprise a metal sheet.

10. The antenna structure of claim 7, wherein at least one of the first, second and third electrically conductive elements comprise a perforated metallic sheet.

11. The antenna structure of claim 7, wherein at least one of the first, second and third electrically conductive elements comprise a metallic grating sheet.

12. The antenna structure of claim 7 further comprising:

at least one dielectric between at least one adjacent pair of the following elements:

the first electrically conductive element, the first coupling, the second electrically conductive element, the second coupling, and the third electrically conductive element.

13. The antenna structure of claim 12, wherein the dielectrics have different dielectric constants.

14. The antenna structure of claim 12 or 13, wherein at least a part of the antenna structure is produced using microstrip or stripline technology.

15. The antenna structure of claim 1, wherein the first electrically conductive element comprises a patch which has, in particular, a rectangular, pentagonal, polygonal or elliptical shape.

16. The antenna structure of claim 15, wherein the length of the patch is matched to the transmission of frequencies from the first frequency band, and the width of the patch is matched to the reception of frequencies from the second frequency band.

17. The antenna structure of claim 1, wherein the first electrically conductive element comprises an aperture through which electromagnetic radiation is transmittable and receivable.

18. The antenna structure of claim 17, wherein said aperture has a dimension in a direction parallel to the first resonant axis being different from a dimension in a direction parallel to the second resonant axis.

19. The antenna structure of claim 17, wherein said aperture is of a rectangular, pentagonal, polygonal or elliptical shape.

20. The antenna structure of claim 1, wherein the second electrically conductive element comprises an opening.

21. The antenna structure of claim 20, wherein the opening in the second electrically conductive element comprises a cruciform slot which is essentially defined by a first and a second elongated slot, and which first and second elongated slots are arranged at right angles to one another.

22. The antenna structure of claim 21, wherein the crossing area of the first and second slots is essentially minimized in order to optimize the decoupling between the first and second couplings.

23. The antenna structure of claim 21 or 22, wherein the first and second couplings are of elongated design, the first coupling runs parallel to the second slot, and the second coupling runs parallel to the first slot.

24. The antenna structure of claim 23, wherein the first coupling has an overhang, which projects beyond the second slot, along its longitudinal side, and the second coupling has an overhang, which projects beyond the first slot along its longitudinal side.

25. The antenna structure of claim 24, wherein the impedance of the first coupling is matched by the length of its overhang and the length of the first slot, and the impedance of the second coupling is matched by the length of its overhang and the length of the second slot.

26. The antenna structure of claim 1, wherein said first coupling is arranged to excite essentially only said first resonant axis and said second coupling is arranged to excite essentially only said second resonant axis.

27. The antenna structure of claim 1, wherein said first electrically conductive element comprises a patch with a dimension in a direction parallel to the first resonant axis being different from a dimension in a direction parallel to the second resonant axis.

28. A transceiving apparatus comprising:

a transmitting device for transmitting electromagnetic signals in a first frequency band;

a receiving device for receiving electromagnetic signals in a second frequency band; and a patch antenna having at least a first port assigned to said transmitting device and a second port assigned to said receiving device, said patch antenna comprising:

a first and second electrically conductive element essentially forming a resonator defining at least a first and second resonant axis;

a first coupling assigned to the first port and arranged to excite said resonator in a direction parallel to said first resonant axis with frequencies of said first frequency band;

a second coupling assigned to the second port and arranged to excite said resonator in a direction parallel to said second resonant axis with frequencies of said second frequency band, wherein said first resonant axis is adapted to transmit said electromagnetic signals in the first frequency band, and said second resonant axis is adapted to receive said electromagnetic signals in the second frequency band, and wherein said first and second couplings are arranged to provide electromagnetic isolation between said first and second port.

29. The transceiving apparatus of claim 28, wherein said first resonant axis is adapted to said first frequency band and said second resonant axis is adapted to said second frequency band which is different from said first frequency band.

30. The transceiving apparatus of claim 28, wherein said first and second resonant axes are adapted to frequency bands which are separated by a guard band.

31. A method for transmitting and receiving electromagnetic signals, said method comprising:

providing a patch antenna with a first and second port for coupling of electromagnetic signals;

a first and second electrically conductive element essentially forming a resonator defining at least a first and second resonant axis;

a first coupling assigned to the first port and arranged to excite said resonator in a direction parallel to said first resonant axis with frequencies of a first frequency band and a second coupling assigned to the second port and arranged to excite said resonator in a direction parallel to said second resonant axis with frequencies of a second frequency band, wherein said first and second couplings are arranged to provide electromagnetic isolation between said first and second port;

transmitting electromagnetic signals in the first frequency band via said first port and said first resonant axis; and receiving electromagnetic signals in the second frequency band via said second port and said second resonant axis.

32. The method of claim 31, comprising:

providing said first coupling being arranged to excite said first resonant axis with frequencies of said first frequency band and providing said second coupling being arranged to excite said second resonant axis with frequencies of said second frequency band being different from said first frequency band.

* * * * *